US008283303B2

(12) United States Patent
Ogura et al.

(10) Patent No.: US 8,283,303 B2
(45) Date of Patent: Oct. 9, 2012

(54) LIQUID DETERGENT COMPOSITION

(75) Inventors: Hirotsugu Ogura, Yokohama (JP); Hiroaki Shindo, Tokyo (JP)

(73) Assignee: Lion Corporation, Sumida-ku, Tokyo (JP)

( * ) Notice: Subject to any disclaimer, the term of this patent is extended or adjusted under 35 U.S.C. 154(b) by 0 days.

(21) Appl. No.: 13/060,298

(22) PCT Filed: Sep. 10, 2009

(86) PCT No.: PCT/JP2009/004495

§ 371 (c)(1), (2), (4) Date: Feb. 23, 2011

(87) PCT Pub. No.: WO2010/029749

PCT Pub. Date: Mar. 18, 2010

(65) Prior Publication Data

US 2011/0160115 A1 Jun. 30, 2011

(30) Foreign Application Priority Data

Sep. 10, 2008 (JP) ..... 2008-232326

(51) Int. Cl.

| | |
|---|---|
| ***C11D 1/22*** | (2006.01) |
| ***C11D 1/72*** | (2006.01) |
| ***C11D 1/83*** | (2006.01) |
| ***C11D 3/42*** | (2006.01) |

(52) U.S. Cl. ..... 510/325; 510/336; 510/337; 510/356; 510/357; 510/360; 510/492; 510/506

(58) Field of Classification Search ..... 510/325, 510/336, 337, 351, 356, 357, 360, 492, 506
See application file for complete search history.

(56) References Cited

U.S. PATENT DOCUMENTS

| | | | | |
|---|---|---|---|---|
| 3,998,750 | A | 12/1976 | Payne et al. | |
| 4,874,537 | A * | 10/1989 | Peterson et al. | 510/304 |
| 5,798,329 | A * | 8/1998 | Taylor et al. | 510/384 |
| 6,090,372 | A * | 7/2000 | Finch et al. | 424/59 |
| 2006/0111261 | A1* | 5/2006 | Sadlowski et al. | 510/221 |

FOREIGN PATENT DOCUMENTS

| | | |
|---|---|---|
| JP | 52-8009 | 1/1977 |
| JP | 5-209191 | 8/1993 |
| JP | 5-222396 | 8/1993 |
| JP | 8-269485 | 10/1996 |
| JP | 10-60496 | 3/1998 |
| JP | 2000-144179 | 5/2000 |
| JP | 2009-144002 | 7/2009 |
| WO | WO 2008/001797 | 1/2008 |

OTHER PUBLICATIONS

English Language Translation of JP05-222396.*
English Language Translation of JP 2000-144179.*
English Language Translation of JP 2009-144002.*
International Search Report from International Application No. PCT/JP2009/004495 dated Nov. 24, 2009 (Form PCT/ISA/210).

* cited by examiner

*Primary Examiner* — Gregory Delcotto
(74) *Attorney, Agent, or Firm* — Merchant & Gould P.C.

(57) ABSTRACT

The present invention includes a liquid detergent composition which yields superior detergency and whitening effects, exhibits excellent storage stability, and comprises 50 to 70% by mass of nonionic surfactant (A) represented by formula (I) or formula (I'), 1 to 10% by mass of anionic surfactant (B), and 0.05 to 1% by mass of 4,4'-bis(2-sulfostyryl)biphenyl disodium salt serving as fluorescent whitening agent (C).

$$R^1CO—(OR^2)_n—OR^3 \quad (I)$$

$$R^4—O—(R^2O)m\text{-}H \quad (I')$$

In formula (I), $R^1$ represents a linear or branched alkyl or alkenyl group of 5 to 21 carbon atoms; $R^2$ represents an alkylene group of 2 to 4 carbon atoms; $R^3$ represents an alkyl group of 1 to 4 carbon atoms; and n is 5 to 30. In formula (I'), $R^4$ represents a hydrocarbon group derived from a secondary alcohol of 8 to 30 carbon atoms; $R^2$ represents an alkylene group of 2 to 4 carbon atoms; and m is 5 to 20.

4 Claims, No Drawings

LIQUID DETERGENT COMPOSITION

This application is a U.S. National Stage Application under 35 U.S.C. §371 of International Patent Application No. of PCT/JP2009/004495, filed 10 Sep. 2009, which claims the benefit of priority to Japanese Patent Application No. 2008-232326, filed 10 Sep. 2008, the disclosures of all of which applications are hereby incorporated by reference in their entireties. The International Application was published in Japanese on 18 Mar. 2010 as WO 2010/029749.

TECHNICAL FIELD

The present invention relates to a liquid detergent composition.

BACKGROUND

Liquid detergents for clothes have been, to this date, non-fluorescent and used mainly for the sake of color care. However, in recent years, as the market for liquid detergents grew, the number of users who mainly use the liquid detergents have increased, and the products appealing higher detergency have also increased. For the sake of detergency appeal, it is thought that not only the removal of dirt but the pursuit of visual whiteness is also necessary in the liquid detergents, as in the powder detergents, by using a fluorescent agent.

In addition, in the field of detergents, a reduction in the amount of detergent composition used, a reduction of waste by reducing the size of a container that contains a detergent composition, or the like has been proposed in recent years as a method for reducing the environmental load, and thus a so-called "concentrated type" with a high surfactant concentration has also been developed for the liquid detergents.

In Patent Document 1, a concentrated liquid detergent composition containing a nonionic surfactant represented by the same general formula as a formula (I) for the component (A) in the present invention as an essential component has been disclosed. An anionic surfactant and a fluorescent agent have been described as optional components.

In Patent Document 2, a concentrated liquid detergent composition containing a nonionic surfactant similar to the component (A) in the present invention which is represented by the formula (I) and an antioxidant as essential components has been disclosed. A fluorescent agent has been described as an optional component.

In Patent Document 3, although not being a liquid detergent of concentrated type, Example 1 regarding a liquid detergent composition containing a nonionic surfactant represented by the same general formula as the formula (I) for the component (A) and a fluorescent agent (unspecified), and Example 3 regarding a liquid detergent composition containing the nonionic surfactant and an anionic surfactant have been disclosed.

Patent Documents

[Patent Document 1] Japanese Unexamined Patent Application, First Publication No. Hei 5-222396

[Patent Document 2] WO 2008/001797A2

[Patent Document 3] Japanese Unexamined Patent Application, First Publication No. Hei 5-209191

DETAILED DESCRIPTION

Problems to be Solved by the Invention

However, even if a surfactant and a fluorescent whitening agent are combined for use in a concentrated liquid detergent composition in order to attain a favorable level of detergency and whitening effect, there are cases where an adequate level of whitening effect is not achieved or storage stability of the liquid detergent composition declines.

The present invention has been developed in view of the aforementioned circumstances, and has an object of providing a liquid detergent composition which yields superior detergency and a whitening effect and also exhibits excellent storage stability.

Means for Solving the Problems

As a result of intensive and extensive studies in order to solve the aforementioned problem, the present inventors discovered that a superior whitening effect can be yielded by using a specific biphenyl-based fluorescent whitening agent (C) and also combining an anionic surfactant (B), and an anionic surfactant can be stably added to thereby achieve superior detergency and excellent storage stability by using a specific nonionic surfactant (A), and they were therefore able to complete the present invention.

The liquid detergent composition of the present invention is characterized by containing 50 to 70% by mass of a nonionic surfactant (A) represented by formula (I) and/or formula (I') shown below, 1 to 10% by mass of an anionic surfactant (B), and 0.05 to 1% by mass of a fluorescent whitening agent (C) represented by formula (II) shown below.

Chemical Scheme 1

$$R^1CO—(OR^2)_n—OR^3 \quad (1)$$

In formula (I), $R^1$ represents a linear or branched alkyl or alkenyl group of 5 to 21 carbon atoms; $R^2$ represents an alkylene group of 2 to 4 carbon atoms; $R^3$ represents an alkyl group of 1 to 4 carbon atoms; and n represents an average number of added moles of —$OR^2$ (alkylene oxide), which is from 5 to 30.

Chemical Scheme 2

$$R^4—O—(R^2O)m\text{-}H \quad (I')$$

In formula (I'), $R^4$ represents a hydrocarbon group derived from a secondary alcohol of 10 to 22 carbon atoms; $R^2$ represents an alkylene group of 2 to 4 carbon atoms; and m represents an average number of added moles of —$R^2O$— (alkylene oxide), which is from 5 to 20.

Chemical Scheme 3

Chemical Scheme 3

(11)

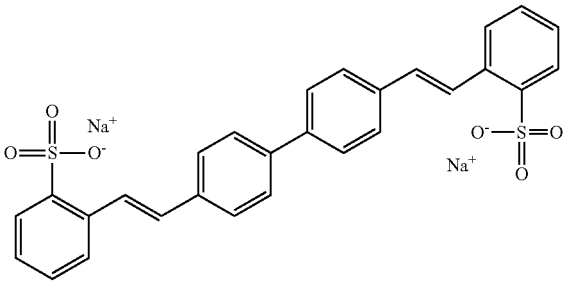

The anionic surfactant (B) preferably contains a linear alkylbenzenesulfonate.

Effects of the Invention

According to the present invention, a liquid detergent composition can be obtained, which yields superior detergency and whitening effect and also exhibits excellent storage stability.

<Nonionic Surfactant (A)>

The nonionic surfactant (A) (hereafter, frequently referred to as a component (A)) is an alkylene oxide adduct represented by the aforementioned general formula (I) and/or formula (I').

By using the component (A), a liquid detergent composition of concentrated type can be obtained with excellent storage stability without causing gelation or the like, even if a surfactant is included at a high concentration level. By making the liquid detergent composition into a concentrated type, an excellent coating detergency can be attained when applying the liquid detergent composition onto the clothes to be washed. In addition, the component (A) exhibits superior water solubility and also contributes to excellent normal detergency when washing clothes in a liquid containing the liquid detergent composition.

In the aforementioned formula (I), $R^1$ represents a linear or branched alkyl group of 5 to 21 carbon atoms, or a linear or branched alkenyl group of 5 to 21 carbon atoms.

The alkyl group or alkenyl group for $R^1$ preferably has 9 to 13 carbon atoms, and more preferably has 11 to 13 carbon atoms from the viewpoints of detergency improvement and storage stability.

$R^2$ represents an alkylene group of 2 to 4 carbon atoms, preferably an alkylene group of 2 to 3 carbon atoms, and more preferably an ethylene group. In addition, in the component (A), $R^2$ may be consisted solely of one type of an alkylene group or two or more types of alkylene groups may be intermingled.

$R^3$ represents an alkyl group of 1 to 4 carbon atoms and preferably represents a methyl group.

n represents an average number of added moles of alkylene oxide (—$OR^2$), which is from 5 to 30. n is preferably from 12 to 18 in terms of improving detergency or liquid stability (especially the stability over time at low temperatures or the like) with respect to the liquid detergent composition.

In the component (alkylene oxide adduct) represented by the aforementioned formula (I), the narrow rate which represents a distribution ratio of the compounds with different number of added moles of alkylene oxide (—$OR^2$) is preferably 20% by mass or more. The upper limit for the narrow rate of substantially 80% by mass or less is preferred. More preferably, the narrow rate is from 20 to 60% by mass. The higher the narrow rate, the more favorable the detergency becomes. However, since the stability over time at low temperatures may decline when the narrow rate is too high, the narrow rate of 30 to 45% by mass is still more preferable.

In the present specification, the term "narrow rate" refers to the value derived from the following mathematical equation (S).

[Equation 1]

$$\text{Narrow rate}=\Sigma_{i=n_{max}-2}^{i=n_{max}+2} Yi \quad \text{(S)}$$

In the equation (S), $n_{max}$ represents the number of added moles of alkylene oxide of alkylene oxide adduct that exists most in the entire component (A) represented by the aforementioned formula (I) (alkylene oxide adducts). i represents the number of added moles of alkylene oxide; and Yi represents a ratio (% by mass) of the alkylene oxide adduct, in which the number of added moles of the alkylene oxide is i, present in the entire component (A) represented by the aforementioned formula (I) (alkylene oxide adducts).

For example, the narrow rate can be controlled by the method used to produce the component (A) represented by the aforementioned formula (I) (alkylene oxide adducts) or the like.

A method for producing the component (A) represented by the aforementioned formula (I) is not particularly limited. However, it can be produced easily, for example, by addition polymerization of an ethylene oxide to a fatty acid alkyl ester with use of a surface modified, composite metal oxide catalyst (refer to Japanese Unexamined Patent Application, First Publication No. 2000-144179).

More specifically, preferred examples of the surface modified, composite metal oxide catalyst include a composite metal oxide catalyst, such as magnesium oxide whose surface is modified by a metal hydroxide or the like and with added metal ions ($Al^{3+}$, $Ga^{3+}$, $In^{3+}$, $Tl^{3+}$, $Co^{3+}$, $Sc^{3+}$, $La^{3+}$, $Mn^{2+}$ or the like); and a catalyst prepared by calcining hydrotalcite whose surface is modified by a metal hydroxide and/or a metal alkoxide, or the like.

In addition, in the surface modification for the composite metal oxide catalyst, the mixing ratio of the composite metal oxide and a metal hydroxide and/or a metal alkoxide is preferably such that 0.5 to 10 parts by mass, more preferably 1 to 5 parts by mass, of the metal hydroxide and/or the metal alkoxide is added with respect to 100 parts by mass of the composite metal oxide.

In the aforementioned formula (I'), $R^4$ represents a hydrocarbon group derived from a secondary alcohol of 10 to 22 carbon atoms; $R^2$ represents an alkylene group of 2 to 4 carbon atoms; and m represents an average number of added moles of —$R^2O$—(alkylene oxide), which is from 5 to 20.

$R^4$ preferably has 10 to 16 carbon atoms, and more preferably has 12 to 16 carbon atoms from the viewpoints of detergency and the liquid detergent stability at low temperatures. $R^2$ represents an alkylene group of 2 to 4 carbon atoms, preferably an alkylene group of 2 to 3 carbon atoms, and more preferably an ethylene group. Also, m represents an average number of added moles of alkylene oxide (—$R^2O$—), which is from 5 to 20, and preferably from 7 to 15 and more preferably from 9 to 15 from the viewpoint of improving detergency and the stability of liquid detergent composition at low temperatures. Examples thereof include secondary alcohols of 12 to 14 carbon atoms to which 9, 12 or 15 mol equivalent of ethylene oxide has been added (SOFTANOL 90, 120 or 150 manufactured by Nippon Shokubai Co., Ltd.).

Either a single material or a mixture of two or more different materials may be used as the component (A).

The amount of the component (A) within the liquid detergent composition is within a range from 50 to 70% by mass, and is preferably from 51 to 65% by mass.

A favorable level of detergency can be attained if the amount of the component (A) is equal to or more than 50% by mass. In addition, a liquid detergent composition of concentrated type which contains a surfactant at high concentrations can be obtained. Further, effectiveness (commercial value) as a concentrated type, liquid detergent composition is enhanced.

When the amount of the component (A) is equal to or less than 70% by mass, and preferably equal to or less than 65% by mass, gelation or the like of the surface of liquid detergent composition over time hardly occurs, and a coating formation in the liquid surface becomes unlikely.

<Anionic Surfactant (B)>

In the present invention, the combination of an anionic surfactant (B) (hereafter, frequently referred to as a component (B)) and a fluorescent whitening agent (C) (hereafter, frequently referred to as a component (C)) represented by the above formula (II) yields a favorable whitening effect. In addition, the component (B) also improves the coating detergency.

As the component (B), for example, a linear alkylbenzene sulfonate (LAS), an alkyl sulfate (AS), a secondary alkanesulfonate (SAS), a polyoxyethylene alkyl ether sulfate (AES), an α-olefin sulfonate (AOS), an α-sulfofatty acid ester salt (α-SF), and a polyoxyethylene alkyl ether carboxylate can be used.

More specifically, preferred examples thereof include:

a linear alkylbenzenesulfonate having an alkyl group of 8 to 16 carbon atoms (LAS);

an alkyl sulfate having an alkyl group of 10 to 20 carbon atoms (AS);

a polyoxyethylene alkyl ether sulfate having an alkyl group of 10 to 20 carbon atoms and to which an average of 1 to 10 moles of ethylene oxide have been added (AES);

an α-olefinsulfonate having an alkyl group of 10 to 20 carbon atoms (AOS);

a secondary alkanesulfonate having an alkyl group of 10 to 20 carbon atoms (SAS);

a salt of an α-sulfofatty acid methyl ester having an alkyl group of 10 to 20 carbons (α-SF); and a polyoxyethylene alkyl ether carboxylate having an alkyl group of 10 to 20 carbon atoms and to which an average of 1 to 10 moles of an ethylene oxide have been added.

Examples of these salts include alkali metal salts such as sodium salts and potassium salts; and alkanolamine salts such as monoethanolamine salts and diethanolamine salts. Of these, alkali metal salts such as sodium salts and potassium salts and monoethanolamine salts are preferred.

The linear alkylbenzenesulfonates (LAS) having an alkyl group of 10 to 14 carbon atoms are more preferred.

The secondary alkanesulfonates (SAS) of 10 to 14 carbon atoms are more preferred.

The polyoxyethylene alkyl ether sulfates (AES) of 10 to 14 carbon atoms are more preferred, and also the average number of moles added of ethylene oxide is more preferably from 1 to 4.

In addition, with respect to the polyoxyethylene alkyl ether sulfates (AES), especially when the number of added moles of ethylene oxide in an ethylene oxide adduct that exists most on a mass basis in all the ethylene oxide adducts that constitute the polyoxyethylene alkyl ether sulfate is defined as "nlmax", a ratio of the sum of ethylene oxide adducts, in which the number of added moles of ethylene oxide is (nlmax−1), nlmax or (nlmax+1), to all ethylene oxide adducts (hereafter, sometimes referred to as a "ratio [(nlmax−1)+(nlmax)+(nlmax+1)]/(Total)) is preferably 55% by mass or more (narrow range ethoxylates (NRES)), and more preferably within a range from 55 to 80% by mass. Ensuring the ratio within the above range improves the fluidity and producibility.

Of the various possibilities described above, linear alkylbenzenesulfonates (LAS), polyoxyethylene alkyl ether sulfates (AES) and secondary alkanesulfonates (SAS) are preferred, and linear alkylbenzenesulfonates (LAS) are more preferred.

Either a single material or a mixture of two or more different materials may be used as the component (B).

The amount of the component (B) within the liquid detergent composition is within a range from 1 to 10% by mass, preferably from 1 to 5% by mass, and more preferably from 2 to 5% by mass.

A favorable level of whitening effect due to the combined use with the component (C) can be attained if the amount of the component (B) is equal to or more than 1% by mass. When the amount of the component (B) is equal to or less than 10% by mass, in the liquid surface of the liquid detergent composition, gelation of the liquid detergent composition itself hardly occurs, and a coating formation becomes unlikely. In addition, the coating detergency also improves favorably.

The main reason why a favorable whitening effect can be attained due to the combined use of the component (B) and the component (C) is thought that the component (B) exhibits an effect of sensitizing the fluorescence emitted by the component (C). More specifically, it is thought that in an excited state, the energy transfer occurs between the component (C) and the component (B), thereby causing the increase in fluorescence. Alternatively, it is thought that the increase in fluorescence is caused by the component (B) to prevent the excitation energy from changing, so as to dissipate, into energy forms other than fluorescence, such as the energy for structural change and the thermal energy. Among the various possibilities for the component (B), it is thought that the LAS in particular exhibits an intensive sensitization action.

<Fluorescent Whitening Agent (C)>

A fluorescent whitening agent (C) used in the present invention is a compound represented by the above formula (II) (4,4'-bis(2-sulfostyryl)biphenyl disodium salt). The component (C) can be made available from commercially available, biphenyl-based fluorescent whitening agents, and for example, the Tinopal-CBS-X (product name, manufactured by Ciba Specialty Chemicals Inc.) can be used.

The component (C) is water soluble and can be added suitably to the liquid detergent composition. The whitening effect by the fluorescent whitening agent enhances the whiteness, thereby improving the visual whiteness of the clothes being washed.

The amount of the component (C) within the liquid detergent composition is within a range from 0.05 to 1% by mass, and is preferably from 0.1 to 0.5% by mass.

A favorable level of whitening effect can be attained if the amount of the component (C) is equal to or more than 0.05% by mass. By ensuring that the amount of the component (C) is not more than 1% by mass, a high level of whitening effect due to the combined use with the component (B) can be attained, and also a good balance can be achieved with the component (A) and the component (B) so as to yield excellent storage stability.

<Other Components>

In addition to the components (A), (B) and (C), to the detergent composition of the present invention, as other components, an additive including a higher fatty acid, a viscosity reducing agent (lower alcohols such as ethanol and isopropyl glycol; and glycols such as ethylene glycol and propylene glycol), a stabilizer (such as sodium benzoate, citric acid, sodium citrate, polyhydric alcohols, polyethylene glycol alkyl ethers, and polypropylene glycol alkyl ethers), a texture improver such as silicone, an antiseptic, a hydrotropic agent, a migration inhibitor, a pearlescent agent, an antioxidant, general dyes and pigments serving as a colorant, a flavoring agent and an emulsifier, as well as a solvent such as water and alcohol can be appropriately added. Other components are not limited to these examples. In addition, the types of other components and the added amount thereof can be selected arbitrarily as long as it does not interfere with the object of the present invention.

The liquid detergent composition of the present invention can be prepared in accordance with ordinary methods.

The liquid detergent composition of the present invention is a so-called "concentrated type" liquid detergent composition, and is suitably used in particular for clothing.

Examples of the method for use include a normal method, that is, a method for loading the liquid detergent composition of the present invention (product of the present invention) in water together with the laundry (materials to be washed) at the time of washing, a method for directly applying the product of the present invention onto the mud dirt or greasy dirt, and a method for soaking the materials to be washed (clothes) by dissolving the product of the present invention in water in advance. In addition, another method is also preferred, in which the product of the present invention is applied onto the laundry, and after leaving the resultant to stand where appropriate, a normal washing is conducted by using a normal washing liquid.

EXAMPLES

A more detailed description of the present invention is presented below using a series of examples, although the present invention is in no way limited by these examples. Unless stated otherwise, "%" refers to "% by mass."

<Production of Liquid Detergent Composition>

Liquid detergent compositions composed of the components shown in Tables 1 and 2 were produced in the following manner in accordance with ordinary methods.

First, the component (A) was placed in a cylindrical glass bottle (having a diameter of 50 mm and a height of 100 mm) with a 2-cm stirrer therein. Next, a mixed solution containing an optional component was added thereto, and the mixture was stirred at 400 rpm using the stirrer. Subsequently, the component (B) was added thereto and stirred, followed by the sequential addition of the component (C) thereto, and the mixture was mixed by stirring. Thereafter, purified water was added thereto in such a manner that the resultant would constitute 95% by mass, if the ultimate mixture was prepared to a total amount of 100% by mass. The mixture was mixed by stirring and the pH thereof was then adjusted, and purified water was added thereto so that the total amount will be 100% by mass, thereby producing a liquid detergent composition.

The pH was adjusted by adding an appropriate amount of pH adjuster (sodium hydroxide or sulfuric acid) so that the pH of the liquid detergent composition at 25° C. reached the values indicated in the tables.

Note that the units for the blend quantities shown in the tables are % by mass and represent the equivalent quantities of the pure components.

A method of measuring the narrow rate of the component (A) represented by the formula (I) and the components shown in the tables will be explained below.

<Method of Measuring the Narrow Rate of the Component (A)>

With respect to the component (A) shown below, a distribution of ethylene oxide adducts with different number of added moles of ethylene oxide was measured by high performance liquid chromatography (HPLC) under the following measurement conditions. Then, the narrow rate (unit: % by mass) of the component (A) was calculated based on the aforementioned mathematical expression (S).

[Conditions for Measuring a Distribution of Ethylene Oxide Adducts by HPLC]

Apparatus: LC-6A (manufactured by Shimadzu Corporation)

Detector: SPD-10A

Measurement wavelength: 220 nm

Column: Zorbax C8 (manufactured by DuPont Co., Ltd.)

Mobile phase: Acetonitrile/water=60/40 (volume ratio)

Flow rate: 1 mL/min

Temperature: 20° C.

<Explanation of the Components Shown in the Tables>

Component (A)

A-1: $C_{11}H_{23}CO(OC_2H_4)_{15}OCH_3$, 33% by mass (narrow rate); synthetic product A-2: a mixture of $C_{11}H_{23}CO(OC_2H_4)_{15}OCH_3$ and $C_{13}H_{27}CO(OC_2H_4)_{15}OCH_3$ at a mass ratio of 8/2, 33% by mass (narrow rate); synthetic product A-3: $C_{11}H_{23}CO(OC_2H_4)_{15}OCH_3$, 45% by mass (narrow rate); synthetic product A-4: a mixture of $C_{11}H_{23}CO(OC_2H_4)_{15}OCH_3$ and $C_{13}H_{27}CO(OC_2H_4)_{15}OCH_3$ at a mass ratio of 8/2, 45% by mass (narrow rate); synthetic product A-5: a secondary alcohol of 12 to 14 carbon atoms to which an average of 9 moles of ethylene oxide was added; SOFTANOL 90 (manufactured by Nippon Shokubai Co., Ltd.)

A-6 (SLAO): (a comparative product): a polyoxyethylene C12-13 alkyl ether, with an average EO chain length of 15 moles and produced by using Safol 23 (product name, manufactured by Sasol Ltd.) serving as a raw material alcohol with a ratio C12/13=55%/45% and a linear chain ratio of 50%.

Note that the term "linear chain rate" indicates a percentage (% by mass) of linear higher alcohols with respect to the combined total of all the higher alcohols.

For the components A-1 to A-4, synthetic products produced in accordance with Production Example 1 in the Example section as disclosed in Japanese Unexamined Patent Application, First Publication No. 2000-144179 were used.

In other words, alumina hydroxide/magnesium with a chemical composition of $2.5MgO.Al_2O_3.nH_2O$ (product name: Kyoward 300, manufactured by Kyowa Chemical Industry Co., Ltd.) was calcined at 600° C. for 1 hour under a nitrogen atmosphere, and 2.2 g of the calcined alumina hydroxide/magnesium (unmodified) catalyst obtained as a result, 2.9 mL of a 0.5 N potassium hydroxide ethanol solution, and 350 g of methyl laurate ester were charged in a 4 liter autoclave, thereby reforming the catalyst in the autoclave. Subsequently, after substituting the inside of the autoclave with nitrogen, the temperature thereof was increased. Then, 1,079 g of ethylene oxide was added thereto while maintaining the temperature at 180° C. and the pressure at 3 atm, so as to allow the reaction to proceed with stirring.

Further, the reaction solution was cooled to 80° C., and 159 g of water and 5 g each of activated clay and diatomaceous earth serving as a filter aid were added thereto followed by filtration of the catalyst, thereby yielding A-1.

Note that the narrow rate of 33% by mass was obtained for A-1 by controlling the added amount of alkali with respect to the catalyst.

A-2 was synthesized in a manner similar to that of the method for synthesizing A-1, with the exception that 280 g of methyl laurate ester and 70 g of methyl myristate ester were used instead of the methyl laurate ester alone, and 1,052 g of ethylene oxide was added in the method for synthesizing A-1.

Note that the narrow rate of 33% by mass was obtained for A-2 by controlling the added amount of alkali with respect to the catalyst.

A-3 was synthesized in a manner similar to that of the method for synthesizing A-1, with the exception that 350 g of methyl laurate ester was used and 1,079 g of ethylene oxide was added in the method for synthesizing A-1.

Note that the narrow rate of 45% by mass was obtained for A-3 by controlling the added amount of alkali with respect to the catalyst.

A-4 was synthesized in a manner similar to that of the method for synthesizing A-1, with the exception that 280 g of methyl laurate ester and 70 g of methyl myristate ester were used instead of the methyl laurate ester alone, and 1,052 g of ethylene oxide was added in the method for synthesizing A-1.

Note that the narrow rate of 45% by mass was obtained for A-4 by controlling the added amount of alkali with respect to the catalyst.

Synthesis of A-6 (a comparative product) was conducted in the following manner 224.4 g of raw material alcohol (Safol 23) and 2.0 g of a 30% by mass aqueous NaOH solution were each placed in a pressure resistant reaction vessel, and the inside of the vessel was substituted with nitrogen.

Next, dehydration was carried out for 30 minutes at a temperature of 100° C. and a pressure of 2.0 kPa or below, the temperature was raised to 160° C. While stirring the alcohol solution, 660 g of ethylene oxide (gaseous) was gradually added to the alcohol solution, with the use of a blowing tube, by adjusting the addition rate of ethylene oxide so that the reaction temperature did not exceed 180° C.

After the addition of ethylene oxide, the mixture was aged for 30 minutes at a temperature of 180° C. and a pressure of 0.3 MPa or below, and unreacted ethylene oxide was then removed by evaporation for 10 minutes at a temperature of 180° C. and a pressure of 6.0 kPa or below.

Next, after the temperature was cooled to 100° C. or below, p-toluene sulfonic acid (a 70% by mass aqueous solution) was added for neutralization so that an aqueous solution containing 1% by mass of the resulting reaction product had a pH value of approximately 7, thereby obtaining A-5 (comparative product).

Note that with respect to A-1 to A-4, the narrow rate was calculated by measuring a distribution of ethylene oxide adducts with different number of added moles of ethylene oxide in the obtained synthesized product by the above-mentioned measuring method for narrow rate.

Component (B)

B-1: LAS, a linear alkyl (10 to 14 carbon atoms) benzenesulfonic acid [manufactured by Lion Corporation, under the trade name of LIPON LH-200 (LAS-H purity: 96% by mass)] having an average molecular weight of 322 (which was neutralized with a sodium hydroxide served as a pH adjuster during preparation of the liquid detergent composition to form a sodium salt).

B-2: AES, polyoxyethylene alkyl ether sodium sulfate having 12 to 13 carbon atoms (average number of moles of added ethylene oxide was 2); a synthetic product.

[Synthesis Method of B-2 (AES)]

400 g of Neodol 23 [product name, manufactured by Shell Chemicals; C12, 13 alcohol (a mixture of 1/1 mass ratio of alcohol of 12 carbon atoms and alcohol of 13 carbon atoms); branch ratio of 20% by mass] serving as a raw material alcohol and 0.8 g of potassium hydroxide catalyst were charged into a 4 liter autoclave. The inside of the autoclave was substituted with nitrogen, and the temperature in the autoclave was raised while stirring the resulting mixture. After that, while maintaining a temperature of 180° C. and a pressure of 0.3 mPa, 272 g of ethylene oxide was introduced to the autoclave, thereby yielding a reactant (alcohol ethoxylate) with an average number of moles of added ethylene oxide of 2.

Next, 280 g of alcohol ethoxylate obtained in the above step was placed in a 500 mL flask equipped with a stirrer, and after substituting the inside of the flask with nitrogen, 67 g of liquid sulfuric anhydride (sulfan) was slowly added dropwise thereto while maintaining the reaction temperature at 40° C. After the completion of the addition, the resulting mixture was further stirred for 1 hour (sulfation reaction) to obtain polyoxyethylene alkyl ether sulfate. Further, this polyoxyethylene alkyl ether sulfate was neutralized with an aqueous sodium hydroxide solution to obtain B-2 (AES). The ratio [(nlmax−1)+(nlmax)+(nlmax+1)]/(Total) was 35% by mass.

B-3: SAS, a secondary alkanesulfonate-Na manufactured by Clariant Japan K.K. under the trade name "SAS30".

B-4: NRES, a synthetic product of polyoxyethylene alkyl ether sodium sulfate having 12 to 13 carbon atoms (average number of moles of added ethylene oxide was 2). As a raw material alcohol, the aforementioned Safol 23 was used.

[Synthesis Method of B-4 (NRES)]

400 g of the aforementioned raw material alcohol and 0.4 g of a solid catalyst prepared by sintering a composite metal oxide containing a Lewis acid and constituted of Al/Mg/Mn were charged into a 4 liter autoclave. The inside of the autoclave was substituted with nitrogen, and the temperature in the autoclave was raised while stirring the resulting mixture. After that, while maintaining a temperature of 180° C. and a pressure of 0.3 mPa, 54 g of ethylene oxide was introduced to the autoclave, thereby yielding a reactant.

Next, 274 g of alcohol ethoxylate obtained in the above step was placed in a 500 mL flask equipped with a stirrer, and after substituting the inside of the flask with nitrogen, 81 g of liquid sulfuric anhydride (sulfan) was slowly added dropwise thereto while maintaining the reaction temperature at 40° C. After the completion of the addition, the resulting mixture was further stirred for 1 hour (sulfation reaction) to obtain polyoxyethylene alkyl ether sulfate, which was the target product. Further, this polyoxyethylene alkyl ether sulfate was neutralized with an aqueous sodium hydroxide solution to obtain B-4 (NRES). The ratio [(nlmax−1)+(nlmax)+(nlmax+1)]/(Total) was 78% by mass.

Component (C)

C-1: CBS-X (product name): 4,4'-bis(2-sulfostyryl)biphenyl disodium salt (manufactured by Ciba Specialty Chemicals Inc.).

C-2 (comparative product): AMS-GX (product name): 4,4'-bis((4-amino-6-morpholino-1,3,5-triazin-2-ylamino) stilbene-2,2'-disulfonic acid salt (manufactured by Ciba Specialty Chemicals Inc.).

C-3 (comparative product): Whitex-SKC (product name): 4,4'-bis-(4-toluidino-6-morpholino-1,3,5-triazin-2-ylamino) stilbene-2,2'-disulfonic acid salt (manufactured by Sumitomo Chemical Co., Ltd.).

Optional Components

Ethanol: manufactured by New Energy and Industrial Technology Development Organization (NEDO) under the trade name of "95 vol. % synthetic ethanol".

Polyethylene glycol: manufactured by Lion Corporation under the trade name of "PEG # 1000-L60".

Water: ion exchanged water was used.

<<Evaluation Methods>>

With respect to the liquid detergent compositions obtained above, an evaluation was conducted based on the method and evaluation criteria shown below. The results are shown in Tables 1 and 2.

1. Normal Detergency Evaluation Method

An artificially stained cloth (manufactured by Zaidanhojin Sentaku Kagaku Kyokai.) which was prepared by soaking a test cloth specified by Japan Oil Chemists' Society (unstained cloth) in artificial dirt was cut into 5 cm×5 cm squares and used as stained cloths. A Terg-O-tometer (United States Testing Company) was used as a washing tester.

Washing liquids were prepared by adding 300 μl (600 μl in Comparative Example 7) of a liquid detergent composition to 900 μl of water and mixing the two by stirring for 30 seconds.

The aforementioned washing liquid, 5 pieces of the stained cloths described above and a knitted cloth for washing were placed in the washing tester, and washing was conducted at a bath ratio of 30-fold, 120 rpm and 10° C. for 10 minutes. Thereafter, they were transferred to a twin-tub washing machine (product name: CW-C30A1-H1, manufactured by Mitsubishi Electric Corporation), and after 1 minute of dehydration, rinsed with 30 L of tap water (15° C., 4° DH) for 3 minutes and then air dried.

With respect to the unwashed stained cloths and the stained cloths after washing, the reflectance was measured using a color difference meter manufactured by Nippon Denshoku Industries Co., Ltd. (product name: SE 200 model), and the washing rate (%) was calculated in accordance with the following formula.

The washing rate (%)=((*K/S* of stained cloth before washing)−(*K/S* of stained cloth after washing))/((*K/S* of stained cloth before washing)−(*K/S* of unstained cloth))×100

In the formula, K/S=(1-R/100)2/(2R/100)(in which R represents the reflectance (%)).

The washing rate (%) was calculated for 5 pieces of stained cloths.

2. Coating Detergency Evaluation Method

100 μl of chili oil was dropwise added to the 5 cm×5 cm-sized test cloth specified by Japan Oil Chemists' Society, and after being air dried at room temperature for 3 hours, the cloth was subjected to rinsing under running water and dried by ironing. The resultant was cut and divided into quarters and used as an oil stained cloth.

60 μl (120 μl in Comparative Example 7) of liquid detergent composition was coated onto one piece of this oil stained cloth, and the resultant was left to stand for 5 minutes.

Water, 5 pieces of the oil stained cloths prepared by coating the liquid detergent composition as described above and a knitted cloth for washing were placed in the washing tester (Terg-O-tometer), and washing was conducted at a bath ratio of 30-fold, 120 rpm and 15° C. for 10 minutes. Thereafter, they were transferred to a twin-tub washing machine (product name: CW-C30A1-H1, manufactured by Mitsubishi Electric Corporation), and after 1 minute of dehydration, rinsed with 30 L of tap water (15° C., 4° DH) for 3 minutes and then air dried.

With respect to the unwashed oil stained cloths and the oil stained cloths after washing, the reflectance was measured using a color difference meter manufactured by Nippon Denshoku Industries Co., Ltd. (product name: SE 200 model), and the washing rate (%) was calculated in accordance with the following formula.

The washing rate (%)=((reflectance of oil stained cloth before washing)−(reflectance of oil stained cloth after washing))/((reflectance of oil stained cloth before washing)−(reflectance of unstained cloth (white cloth)))×100

The washing rate (%) was calculated for 5 pieces of oil stained cloths.

3. Whiteness Evaluation Method 5 pieces of 5 cm×5 cm-sized cotton calico, a knitted cloth for washing which had not emitted fluorescence and a washing liquid were placed in the washing tester (Terg-O-tometer), and washing was conducted at a bath ratio of 30-fold, 120 rpm and 15° C. for 10 minutes. Washing liquids were prepared by adding 300 μl (600 μl in Comparative Example 7) of a liquid detergent composition to 900 μl of water and mixing the two by stirring for 30 seconds.

Thereafter, they were transferred to a twin-tub washing machine (product name: CW-C30A1-H1, manufactured by Mitsubishi Electric Corporation), and after 1 minute of dehydration, rinsed with 30 L of tap water (15° C., 4° DH) for 3 minutes and then air dried.

After repeating the washing three times under these conditions, the whiteness of this cotton calico was measured using a whiteness meter manufactured by Nippon Denshoku Industries Co., Ltd (product name: PF-10 model). The whiteness was calculated based on the presence and absence of a process for irradiating ultraviolet ray which was specified as the whiteness degree W by International Organization for Standardization (ISO). The whiteness was calculated for 5 pieces of cotton calico, and the average thereof is shown in the tables. The higher the whiteness, the whiter the appearance.

4. Safety Evaluation Method

The liquid detergent composition was collected in a cylindrical glass bottle, and the lid was closed, and the bottle was then stored in a thermostatic bath at 5° C. for 1 month. The liquid appearance after the storage was visually observed, and the storage stability was evaluated based on the following criteria.

○: Exhibiting uniformity and fluidity

Δ: Observation of gelation x: Observation of solidification

TABLE 1

| Center composition | | | | | | | | | | |
|---|---|---|---|---|---|---|---|---|---|---|
| | | Examples | | | | | | | | |
| | | 1 | 2 | 3 | 4 | 5 | 6 | 7 | 8 | 9 |
| Used amount (μl/900 ml) | | 300 | 300 | 300 | 300 | 300 | 300 | 300 | 300 | 300 |
| Coated amount (μl/piece) | | 60 | 60 | 60 | 60 | 60 | 60 | 60 | 60 | 60 |
| Component (A) | A-1 | | | | | 52 | | | | |
| | A-2 | 52 | 52 | 52 | 52 | | | | 52 | 52 |
| | A-3 | | | | | | 52 | | | |
| | A-4 | | | | | | | 52 | | |
| | A-5 | | | | | | | | | |
| Component (B) | B-1 LAS | 2.5 | | | | 2.5 | 2.5 | 2.5 | 1 | 10 |
| | B-2 AES | | 2.5 | | | | | | | |
| | B-3 SAS | | | 2.5 | | | | | | |
| | B-4 NRES | | | | 2.5 | | | | | |
| Component (C) | C-1 CBS | 0.1 | 0.1 | 0.1 | 0.1 | 0.1 | 0.1 | 0.1 | 0.1 | 0.1 |
| Optional components | PEG | 5 | 5 | 5 | 5 | 5 | 5 | 5 | 5 | 5 |
| | EtOH | 1 | 1 | 1 | 1 | 1 | 1 | 1 | 1 | 1 |
| | Water | Balance | Balance | Balance | Balance | Balance | Balance | Balance | Balance | Balance |
| pH* | | 7 | 7 | 7 | 7 | 7 | 7 | 7 | 7 | 7 |
| Normal detergency | | 66 | 62 | 65 | 60 | 65 | 65 | 65 | 62 | 60 |
| Coating detergency | | 54 | 52 | 54 | 53 | 54 | 54 | 54 | 48 | 58 |
| Whiteness | | 2.2 | 1.8 | 1.7 | 1.7 | 2.2 | 2.2 | 2.2 | 1.9 | 2.4 |
| Stability | | ○ | ○ | ○ | ○ | ○ | ○ | ○ | ○ | ○ |

TABLE 1-continued

| Center composition | | | | | | | | |
|---|---|---|---|---|---|---|---|---|
| Comments | | Different type of anionic surfactant was used | | Different type of MEE was used | | | Different amount of anionic surfactant was used | |
| | | Examples | | | | | | |
| | | 10 | 11 | 12 | 13 | 14 | 15 | 16 |
| Used amount (μl/900 ml) | | 300 | 300 | 300 | 300 | 300 | 300 | 300 |
| Coated amount (μl/piece) | | 60 | 60 | 60 | 60 | 60 | 60 | 60 |
| Component (A) | A-1 | | | | | | | |
| | A-2 | 65 | 65 | 52 | 52 | 52 | 52 | |
| | A-3 | | | | | | | |
| | A-4 | | | | | | | |
| | A-5 | | | | | | | 52 |
| Component (B) | B-1 LAS | 2.5 | 1 | 2.5 | 2.5 | 2.5 | 2.5 | 2.5 |
| | B-2 AES | | | | | | | |
| | B-3 SAS | | | | | | | |
| | B-4 NRES | | | | | | | |
| Component (C) | C-1 CBS | 0.1 | 0.1 | 0.05 | 0.2 | 0.5 | 1 | 0.1 |
| Optional components | PEG | 5 | 5 | 5 | 5 | 5 | 5 | 5 |
| | EtOH | 1 | 1 | 1 | 1 | 1 | 1 | 1 |
| | Water | Balance | Balance | Balance | Balance | Balance | Balance | Balance |
| pH* | | 7 | 7 | 7 | 7 | 7 | 7 | 7 |
| Normal detergency | | 74 | 72 | 65 | 65 | 65 | 65 | 60 |
| Coating detergency | | 61 | 59 | 54 | 54 | 54 | 54 | 48 |
| Whiteness | | 2 | 1.7 | 1.5 | 3.6 | 6 | 8.4 | 1.6 |
| Stability | | ○ | ○ | ○ | ○ | ○ | ○ | ○ |
| Comments | | Different amount of nonionic surfactant was used | Different amount of anionic surfactant and nonionic surfactant was used | Different amount of CBS was used | | | | SOFTANOL |

*pH was adjusted with sulfuric acid or sodium hydroxide

Component (A)

A-1 to A-4: synthetic product manafactured in accordance with the synthesis method described in Japanese Unexamined Patent Application. First Publication No. 2000-144179

A-1: C11H23CO(OC2H4)15OCH3, 33% by mass (narrow rate); synthetic product

A-2: a mixture of C11H23CO(OC2H4)15OCH3 and C13H27CO(OC2H4)15OCH3 at a mass ratio of 8/2, 33% by mass (narrow rate); synthetic product A-3: C11H23CO(OC2H4)15OCH3, 45% by mass (narrow rate); synthetic product A-4: a mixture of C11H23CO(OC2H4)15OCH3 and C13H27CO(OC2H4)15OCH3 at a mass ratio of 8/2, 45% by mass narrow rate); synthetic product The narrow rate was calculated by measuring a distribution of ethylene oxide adducts with different number of added moles of ethylene oxide in the obtained polyoxyethylene methyl ether laurate.

A-5: a secondary alcohol of 12 to 14 carbon atoms to which an average of 9 moles of ethylene oxide was added; SOFTANOL 90 (manufactured by Nippon Shokubai Co. Ltd.)

SLAO: a polyoxyethylene C12-13 alkyl ether (with an average EO chain length of 15 moles and produced by using Safol 23 (manufacured by Sasol Ltd.) serving as a material alcohol with a ratio C12/13 = 55%/45% and a linear chain ratio of 50%)

Component (B)

B-1: LAS: a linear alkyl benzenesulfonic acid: R (C10-14) having an average molecular weight of 322 (manufacured by Lion Corporation)

B-2: AES: a mixture of polyoxyethylene alkyl ether sodium sulfates having 12 to 13 carbon atoms: with an average EO chain length of 2 moles (raw material alcohol: Neodol 23 (product name, manufacured by Shell Chemicals))

B-3: SAS: a secondary alkanesulfonate-Na (manufactured by Clariant Japan K.K.)

B-4: NRES: a sodium alkyl ethoxy sulfate ester having 12 to 33 carbon atoms (with an average EO chain length of 2 moles, raw material alcohol: Safol 23 (manufacured by Sasol Ltd.) with a ratio C12/13 = 55%/45% and a linear chain ratio of 50%)

Component (C)

C-1: CBS: 4,4'-bis(2-sulfostyryl)biphenyl disodium salt (manufactured by Ciba Specialty Chemicals Inc.).

C-2: Comparative Example

C-2: AMS: 4,4'-bis((4-amino-6-morpholino-1,3,5-rriazin-2-ylamino)srilbene-2,2'-disulfonate, sodium salt (manufacured by Ciba Specialty Chemicals Inc.)

C-3: Whitex-SKC: 4,4'-bis-(4-toluidino-6-morpholino-1,3,5-triazin-2-ylamino)stitbene-2,2'-disulfonic acid salt (manufactured by Sumitomo Chemical Co., Ltd.)

Optional components

Ethanol: manufactured by NEDO under the trade name of "95 vol % synthetic ethanol"

TABLE 2

| | | Comparative Example | | | | | | |
|---|---|---|---|---|---|---|---|---|
| | | 1 | 2 | 3 | 4 | 5 | 6 | 7 |
| Used amount (μl) | | 300 | 300 | 300 | 300 | 300 | 300 | 600 |
| Coated amount (μl) | | 60 | 60 | 60 | 60 | 60 | 60 | 120 |
| Component (A) | A-1 | | | | | | | |
| | A-2 | 52 | 52 | 52 | 52 | | | 30 |
| | A-3 | | | | | | | |
| | A-4 | | | | | | | |

TABLE 2-continued

| | | Comparative Example | | | | | | |
|---|---|---|---|---|---|---|---|---|
| | | 1 | 2 | 3 | 4 | 5 | 6 | 7 |
| (Comparative Example) A-5 | | | | | | 52 | 52 | |
| Component (B) | B-1 LAS | 2.5 | 2.5 | 2.5 | | | 2.5 | 2.5 |
| | B-2 AES | | | | | | | |
| | B-3 SAS | | | | | | | |
| | B-4 NRES | | | | | | | |
| Component (C) | C-1 CBS | | | | 0.1 | 0.1 | 0.1 | 0.1 |
| | C-2 AMS | | 0.1 | | | | | |
| | C-3 | | | 0.1 | | | | |
| Optional components | PEG | 5 | 5 | 5 | 5 | 5 | 5 | 5 |
| | EtOH | 1 | 1 | 1 | 1 | 1 | 1 | 1 |
| pH* | | 7 | 7 | 7 | 7 | 7 | 7 | 7 |
| Normal detergency | | 65 | 65 | 65 | 61 | 54 | 45 | 64 |
| Coating detergency | | 54 | 54 | 54 | 48 | 46 | 43 | 38 |
| Whiteness | | 0 | 0.3 | 0.3 | 1.2 | 1.2 | 1.8 | 3.4 |
| Stability | | ○ | Precipitate formation | Precipitate formation | ○ | Δ | X | ○ |
| Comments | | No CBS | AMS | Whitex | No anionic surfactant | Different type of nonionic surfactant No anionic surfactant | Different type of nonionic surfactant | Low amount of MEE Large amount of used composition |

*pH was adjusted with sulfuric acid or sodium hydroxide

Component (A)

A-1 to A-4: synthetic product manufactured in accordance with the synthesis method described in Japanese Unexamined Patent Application, First Publication No. 2000-144179

A-1: C11H23CO (OC2H4)15OCH3, 33% by mass (narrow rate): synthetic product

A-2: a mixture of C11H23CO(OC2H4)15OCH3 and C13H27CO(OC2H4)15OCH3 at a mass ratio of 8/2, 33% by mass narrow rate); synthetic product A-3: C11H23CO(OC2H4)15OCH3, 45% by mass (narrow rate); synthetic product A-4: a mixture of C11H23CO(OC2H4)15OCH3 and C13H27CO(OC2H4)15OCH3 at a mass ratio of 8/2, 45% by mass (narrow rate); synthetic product The narrow rate was calculated by measuring a distribution of ethylene oxide adducts with different number of added moles of ethylene oxide in the obtained polyoxyethylene methyl ether lanrate.

A-5: a secondary alcohol of 12 to 14 carbon atoms to which an average of 9 moles of ethylene oxide was added: SOFTANOL 90 (manufactured by Nippon Shokubai Co., Ltd.)

SLAO: a polyoxyethylene C12-13 alkyl ether (with an average EO chain length of 15 moles and produced by using Safol 23 (manufactured by Sasol Ltd.) serving as a raw material alcohol with a ratio C12/13 = 55%/45% and a linear chain ratio of 50%)

Component (B)

B-1: LAS: a linear alkyl benzenesulfonic acid: R (C10-14) having an average molecular weight of 322 (manufactured by Lion Corporation)

B-2: AES: a mixture of polyoxyethylene alkyl ether sodium sulfates having 12 to 13 carbon atoms: with an average EO chain length of 2 moles (raw material alcohol: Neodol 23 (product name, manufactured by Shell Chemicals))

B-3: SAS: a secondary alkanesultionate-Na (manufactured by Clariant Japan K.K.)

B-4: NRES: a sodium alkyl ethoxy sulfate ester having 12 to 13 carbon atoms (with an average EO chain length of 2 moles, raw material alcohol: Safol 23 (manufactured by Sasol Ltd.) with a ratio C12/13 = 55%/45% and a linear chain ratio of 50%)

Component (C)

C-1: CBS: 4,4'-bis(2-sulfostyryl)biphenyl disodium salt (manufactured by Ciba Specialty Chemicals Inc.).

C-2: Comparative Example

C-2: AMS: 4,4'-bis((4-amino-6-morpholino-1,3,5-triazin-2-ylamino)stilbene-2,2'-disulfonate, sodium salt (manufactured by Ciba Specialty Chemicals Inc.)

C-3: Whitex-SKC: 4,4'-bis-(4-toluidino-6-morpholino-1,3,5-triazin-2-ylamino)stilbene-2,2'-disulfonic acid salt (manufactured by Sumitomo Chemical Co., Ltd.)

Optional components

Ethanol: manufactured by NEDO under the trade name of "95 vol % synthetic ethanol"

As indicated in the results shown in Tables 1 and 2, the liquid detergent compositions of Examples 1 to 15 exhibited excellent normal detergency and coating detergency, and also high whiteness as well as favorable storage stability. In particular, high whiteness was obtained when the LAS was used as the component (B).

On the other hand, the whiteness was low and no whitening effect was obtained in Comparative Example 1 where the component (C) was not used.

In Comparative Examples 2 and 3 where a stilbene-based fluorescent whitening agent (i.e., AMS or Whitex) was used instead of the component (C) of the present invention, not only the whiteness was low but also the storage stability was poor to form precipitates.

In Comparative Example 4 where the component (B) was not used, the whiteness was inferior in spite of the inclusion of the component (C).

In Comparative Example 5 where a nonionic surfactant other than the component (A) was used and also the component (B) was not used, the normal detergency, the whiteness and the storage stability were inferior in spite of the use of the component (C).

In Comparative Example 6 where a nonionic surfactant, other than the component (A), and the component (B) were used in combination, the normal detergency and the storage stability were inferior. In other words, it was not possible to stably add the component (B) with a nonionic surfactant other than the component (A).

In Comparative Example 7 where the amount of the component (A) included in the liquid detergent composition was low, the coating detergency was inferior even if the amount of the liquid detergent composition used was increased at the time of washing.

INDUSTRIAL APPLICABILITY

The liquid detergent composition of the present invention is suitable for clothes, exhibits excellent normal detergency and coating detergency, and can also achieve a whitening effect.

The invention claimed is:

1. A liquid detergent composition comprising:

50 to 70% by mass of a nonionic surfactant (A) represented by formula (I) shown below;

1 to 5% by mass of an anionic surfactant (B) containing a linear alkylbenzenesulfonate; and 0.05 to 1% by mass of a fluorescent whitening agent (C) represented by formula (II) shown below, wherein the narrow rate of the nonionic surfactant (A) represented by the formula (I) is from 20 to 45% by mass:

$$R^1CO—(OR^2)_n—OR^3 \quad (I)$$

wherein in formula (I), $R^1$ represents a linear or branched alkyl or alkenyl group of 5 to 21 carbon atoms; $R^2$ represents an alkylene group of 2 to 4 carbon atoms; $R^3$ represents an alkyl group of 1 to 4 carbon atoms; and n represents an average number of added moles of —$OR^2$, which is from 5 to 30;

(II)

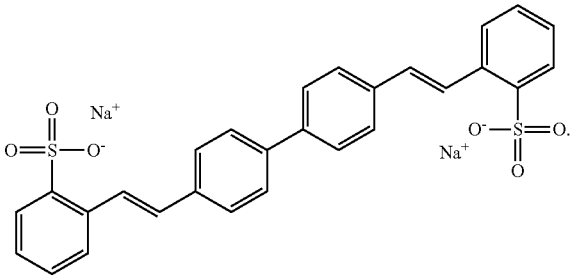

2. The liquid detergent composition according to claim 1, wherein the nonionic surfactant (A) comprises $C_{11}H_{23}CO(OC_2H_4)_{15}OCH_3$.

3. The liquid detergent composition according to claim 1 comprising:

51 to 70% by mass of the nonionic surfactant (A);

1 to 5% by mass of the anionic surfactant (B); and 0.1 to 0.5% by mass of the fluorescent whitening agent (C).

4. The liquid detergent composition according to claim 1 comprising:

51 to 65% by mass of the nonionic surfactant (A);

1 to 5% by mass of the anionic surfactant (B); and 0.1 to 0.5% by mass of the fluorescent whitening agent (C).

* * * * *